United States Patent [19]

Hintz

[11] 4,143,495

[45] Mar. 13, 1979

[54] SOUND-ABSORBING PANEL

[75] Inventor: Ulrich Hintz, Hüttental-Weidenau, Fed. Rep. of Germany

[73] Assignee: Fa. Pass & Co., Hüttental-Weidenau, Fed. Rep. of Germany

[21] Appl. No.: 836,735

[22] Filed: Sep. 26, 1977

Related U.S. Application Data

[63] Continuation-in-part of Ser. No. 734,888, Oct. 22, 1976, abandoned, which is a continuation of Ser. No. 615,295, Sep. 22, 1975, abandoned, which is a continuation of Ser. No. 493,713, Aug. 1, 1974, abandoned.

[51] Int. Cl.[2] ..... E04B 1/86

[52] U.S. Cl. ..... 52/145; 52/397; 181/290

[58] Field of Search ..... 181/284, 285, 286, 290, 181/291, 292, 293, 218; 404/32; 52/144, 145, 397

[56] References Cited

U.S. PATENT DOCUMENTS

| | | | |
|---|---|---|---|
| 2,079,878 | 5/1937 | Sabine | 52/400 |
| 2,423,199 | 7/1947 | Milnor | 52/144 |
| 3,224,155 | 12/1965 | Rook | 52/593 |
| 3,384,199 | 5/1968 | Eckel | 181/290 |
| 3,948,009 | 4/1976 | Bernhard | 181/290 |

*Primary Examiner*—John E. Murtagh

*Attorney, Agent, or Firm*—Norman S. Blodgett; Gerry A. Blodgett

[57] ABSTRACT

A sound-absorbing panel having a front and a rear sheet, the front sheet being corrugated and perforated; a filler of particles of elastic material lies between the sheets.

8 Claims, 5 Drawing Figures

SOUND-ABSORBING PANEL

REFERENCE TO CO-PENDING APPLICATIONS

This application is a continuation-in-part of application Ser. No. 734,888 filed Oct. 22, 1976, now abandoned, which is a continuation of application Ser. No. 615,295 filed Sept. 22, 1975, now abandoned which was a continuation of application Ser. No. 493,713 filed Aug. 1, 1974 now abandoned.

BACKGROUND OF THE INVENTION

The invention relates to a sound-absorbing or noise-prevention element constructed in sheet form in particular and consisting of a hollow body with at least one perforated surface and a filling of sound-absorbing material. Elements of this kind are used, for example, in order to screen off residential areas and isolating estates from sources of noise, such as airports and roads subject to heavy traffic, etc. They can be employed for the purpose of reducing the echo occurring on enclosed premises or lowering the noise level in crowded rooms. In German Registered Design No. 1,857,655 a process is described in which, to protect inner rooms from noise emanating from exterior sources, windows are provided with blinds in which the slats consist of at least partly perforated strips of metal which enclose a cavity filled with sound-absorbing fibrous material. Blinds of this kind are expensive to produce, and their applications are strictly limited.

For use in the open air, German Registered Design No. 1,844,032 describes noise-screening panels which are made of a material resistant to the effects of the weather and which are to be used in comparatively large sizes. To increase the stability, these noise-screening panels can be erected with double sheets which are rigidified with respect to each other by means of sheet-connecting traverses, the space between them being filled with noise-inhibiting substance. The sound-absorbing capacity of such noise screening panels has proved inadequate; sound waves impinging on the front sheet, for example, can be directly transmitted to the rear sheet via the traversed. The sound-inhibiting substance, although protected from the effects of the weather by the fact that it is enclosed between them, is by-passed by the sound, for the same reason.

According to German Pat. No. 1,302,413, large-area sound-screening panels are to be formed by a multiplicity of narrow board-shaped elements consisting of a layer which is inserted, sprayed or stuck into grooves and which has a sound-absorbing effect. The board-shaped elements should be capable of being either combined to form dense panels or positioned obliquely in the manner of the slats of blinds. The drawbacks of this system are the unsatisfactory sound-absorbing capacity and the considerable mechanical sensitivity resulting from exposed or ever overhanging sound-absorbing layers, in addition to the expenditure involved in practice in rendering the structure sufficiently resistant to weather conditions. These and other difficulties experienced with the prior art devices have been obviated in a novel manner by the present invention.

It is, therefore, an outstanding object of the invention to provide a noise prevention or noise-absorbing element of the type described above which can be erected at only moderate expense, despite its high sound-absorbing capacity, and which can be used universally by reasons of its great stability and resistance to weather conditions.

With this and other objects in view, as will be apparent to those skilled in the art, the invention resides in the combination of parts set forth in the specification and covered by the claims appended hereto.

SUMMARY OF THE INVENTION

In general, the invention consists of a system in which the sound-absorbing element takes the form of a hollow body having at least one perforated panel surface together with a filling of sound-absorbing material consisting of shredded or granulated scrap rubber, preferably made from old rubber tires. This shredded or granulated scrap rubber is not only inexpensive to procure; it is also highly resistant to weather conditions and to ageing and is found to have high absorption values when used as described. It is not necessary that the shredded or granulated scrap rubber be inserted or pressed in a loose state into the hollow bodies: the shreds or granulate of scrap rubber of the filling can be glued or stitched together, to form a cohesive mat, in order to render the structure more rigid or to form further cavities. Good results have been obtained with a quilt-like casing provided for the shreds or granulate of scrap rubber and surrounding the filling in the hollow body.

It has also been found advantageous to construct the hollow body of two panel surfaces gripped by a frame consisting of U-shaped sections. Metal sheets, preferably profiled, have proved to be a favorable means of constructing the panel surfaces, a trapezoidal profile having been found desirable. The panel surface provided with the perforations can also be constructed in the form of a wire grating or wire netting. It has been found advantageous for the areas of the holes or meshes to total at least 25 percent (but preferably at least 30 percent) of the area of the wall. Not only panel surfaces of sheet metal but also those of plastic, wood, chipboard, asbestos cement and/or concrete have given good results. These panel surfaces can be braced in relation to one another particularly along the edges where they may include spacer bars. Panel surfaces can be advantageously supported in relation to one another via intermediate layers of an elastic material. The absorbent effect can be increased if the panel surfaces enclosing the shredded or granulated scrap rubber are situated, a distance from a further panel surface. The resulting additional cavity can likewise be provided with sound-absorbing material. Sound absorption is also obtained if at least one of the panel surfaces has profiles forming compartments, which contain the shredded and/or granulated scrap rubber. When the system is used in the open, it is advisable for at least one of the spacer bars or frame bars to be provided with holes, channels or grooves, so that all rain water or splashed water will drain off. The sound-absorbing or noise-prevention element need not necessarilty occupy one fixed position, forming baffles, walls or a building, etc., but may also constitute the leaf of a door or the shutter of a window.

DESCRIPTION OF THE PREFERRED EMBODIMENT

Figure 1:
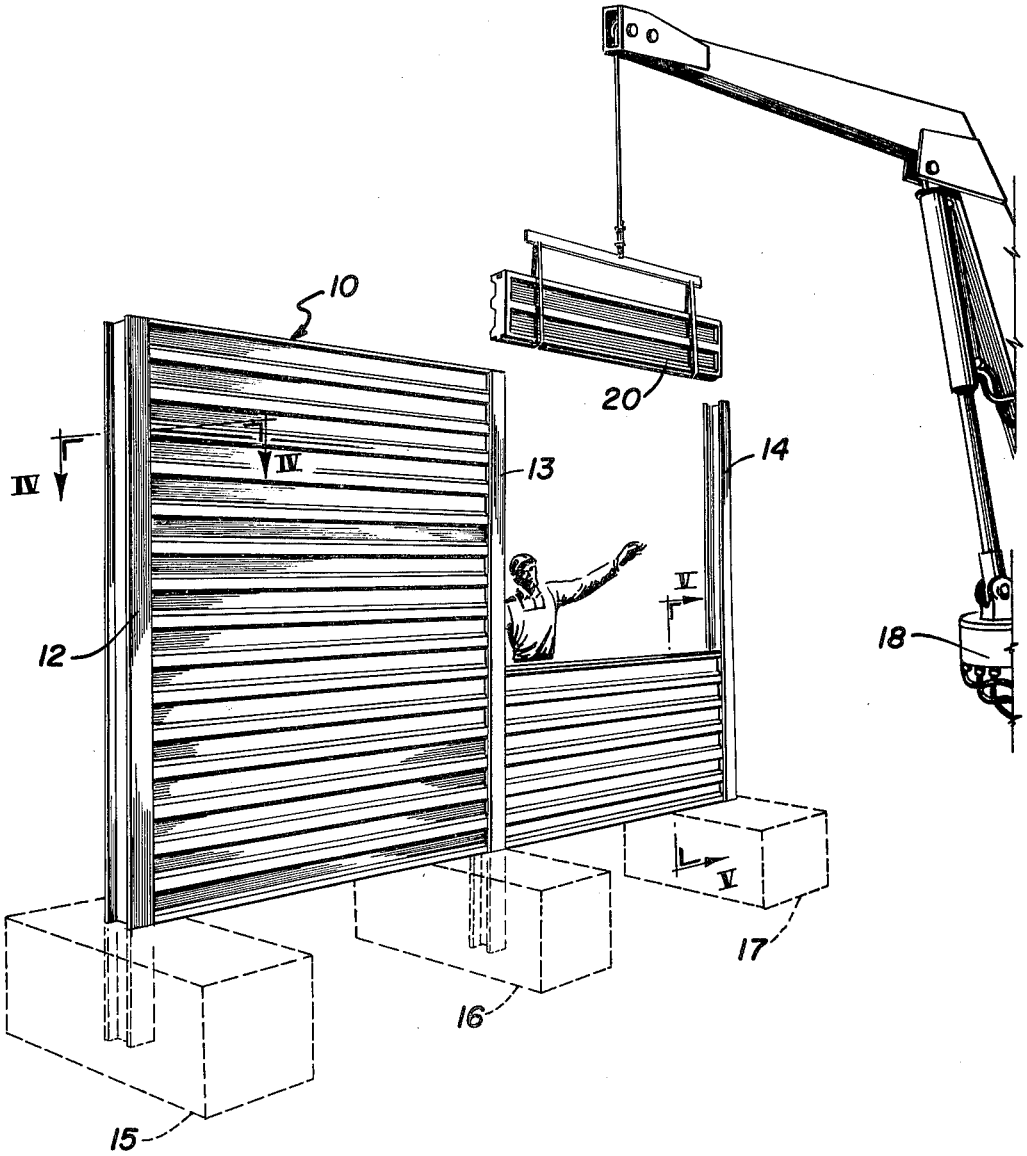
FIG. 1 is a perspective view of a sound-absorbing element incorporating the principles of the present invention, shown during construction.

FIG. 1 shows the assembly of a sound-absorbing element, designated generally by the reference numeral 10, by means of a crane truck 18. Vertical posts 12, 13, and 14 are embedded in concrete blocks 15, 16, and 17, respectively and are in the form of I-beams. The truck has a supply of individual panels 20 that are guided into place between the posts by the worker 19.

Figure 2:
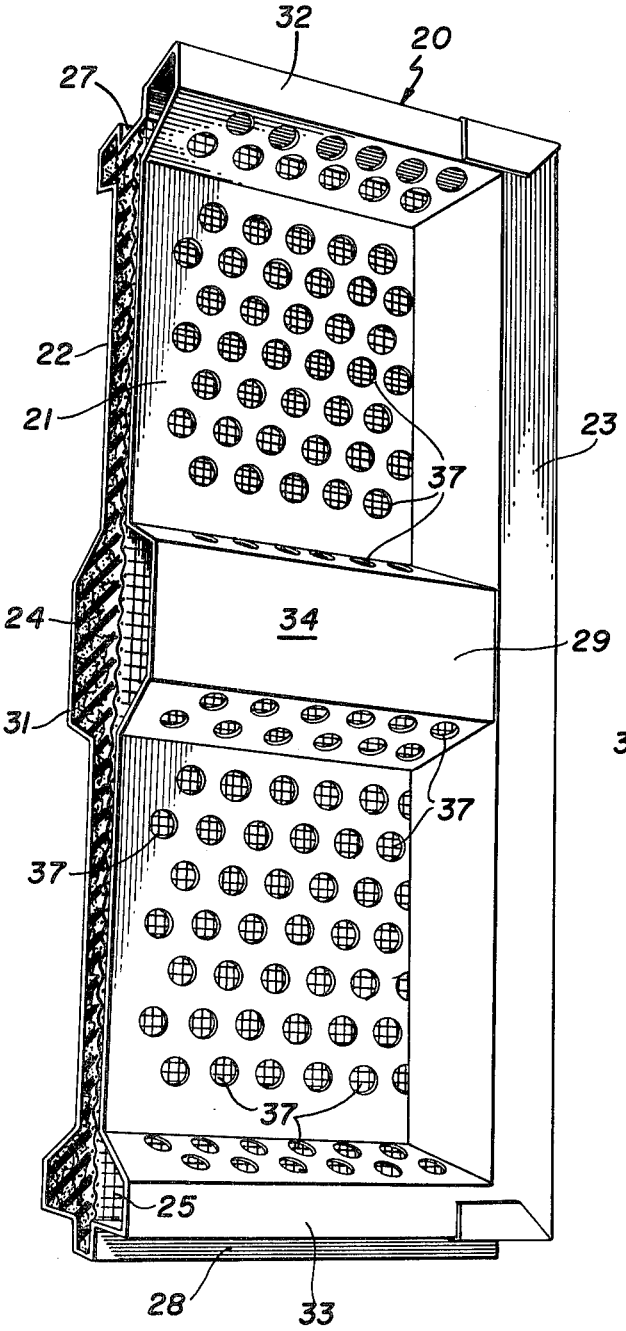
FIG. 2 is a perspective view from the front with portions broken away of a panel.
Figure 3:
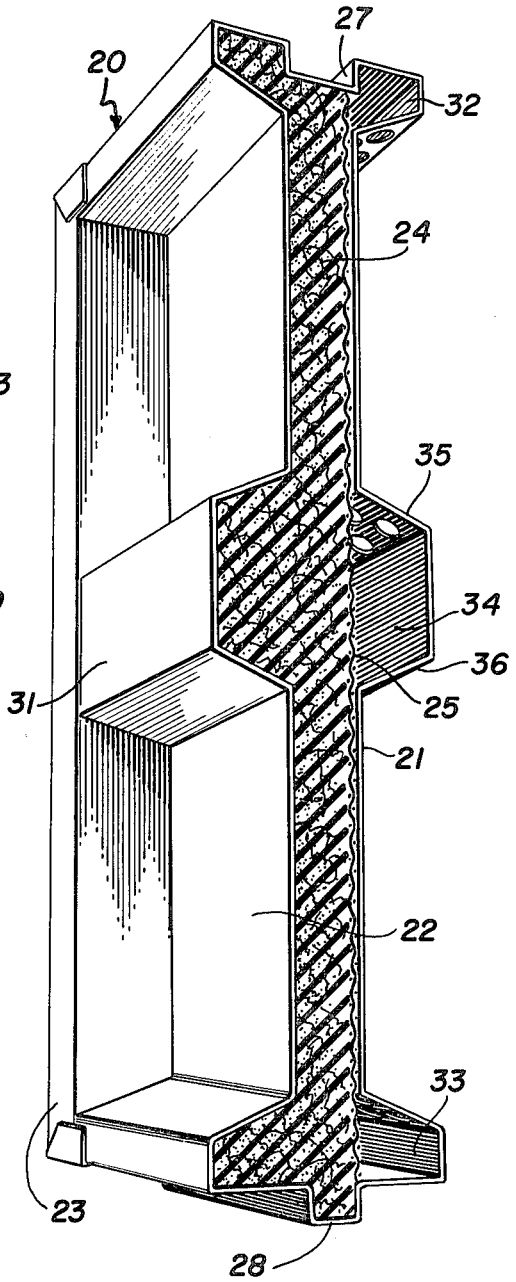
FIG. 3 is a perspective view from the rear of the panel.

Referring to FIGS. 2 and 3, it can be seen that the sound-absorbing panel 20 is constructed as a rectangular sheet. This panel is defined by a perforated front sheet 21 and a rear sheet 22 which are surrounded by frame bars 23 having a U-shaped profile. According to the invention, an insulating plate 24 lies between the sheets and is made of rubber shreds or rubber granulate, which are stuck together, preferably by the use of pressure and, thus, form a cohesive but nevertheless non-homogeneous plate. The granulate and the shreds are in each case stuck together by those of their surfaces which are in contact.

To increase the ability to resist loading, the sheets 21 and 22 are made of profiled or corrugated sheet metal. In the example, the trapezoidal profiles of the sheets 21 and 22, not only for static reasons, differ from one another both as regards their pitch and as regards the depth of the profile. The perforated sheet 21 is formed with a thickness of 1 mm, has a greater pitch, and has a greater profile depth, so that cavities which increase the sound absorption are formed in front of the insulating plate 24. The profiling of the sheet 22 mainly serves to increase its rigidity or improve its resistance. The insulating plate 24 is held partly free between the sheets 21 and 22. Making the profile pitches differ from each other enables the supporting system to be kept free of any frequency periodicity which might cause certain particular frequency ranges to become predominant.

The use of scrap rubber shreds or granulate, preferably made from old tires, provides a filling material obtainable at only moderate cost. A particularly favorable feature of this system is the fact that this filling material can be produced by utilizing and converting scrap rubber or covers which could otherwise not be disposed of without problems and considerable expense. Particular advantages are offered by the fact that not only the all-rubber tread surfaces of the tires can be used for this purpose but the rest of the covering likewise. The operation of cutting the material into smaller pieces is likewise inexpensive: the length of the shreds may amount to between 3 and 60 mm. A further advantage is the fact that, in contradistinction to the mineral wood widely used as a sound insulating filling material, the properties of the rubber remain unaffected by the action of moisture or water. According to the invention, sound-absorbing elements in which shredded or granulated rubber is used as a filling material also prove to be suitable for use on damp premises or for erection in the open.

In the example shown, the sheets 21 and 22 are held together solely by the frame bars 23 surrounding the sound-absorbing element and supporting the said sheets. In order to prevent the transmission of acoustic vibrations from the sheet 21 via the frame bars 23 to the sheet 22, elastic intermediate layers are provided, which may consist of rubber or of an elastic plastic and which prevent all direct contact. If necessary, both the cohesion and the stability can be increased by connections additionally provided between the overlapping branches of the frame bars and the panel surfaces, or else special clamping bolts may be provided along the edge zones and also utilized for securing the noise-prevention element. Here again, it is advisably to provide elastic intermediate layers in order to prevent any contact (either direct or taking place by way of mechanically fixed parts) between the panel surfaces.

Figure 5:
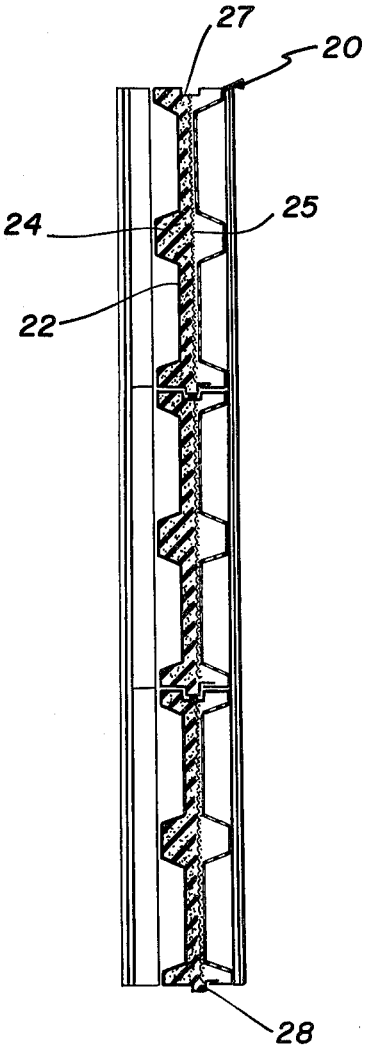
FIG. 5 is a vertical sectional view of the element taken on the line V—V of FIG. 1.

FIG. 5 is a cross-section through the sound-absorbing panel 20. The sheet 22 is situated, at a certain distance, opposite a wire grating 25 supporting itself on the perforated sheet 21. The cavity formed between the sheet 22 and the wire grating 25 is filled with rubber granulate 26 and also with rubber shreds, inserted in a loose state, so that in this case they merely lie on one another, tightly packed together, but without being interconnected. The sheet 22 and the perforated sheet 21 are made of profiled sheet metal and are held together by frame bars 23 of U-shaped profile which surround them. The main purpose of the wire grating 25 is to limit the space to be occupied by the granulated rubber in the plate 24.

The upper edge of each panel 20 is provided with a groove 27 adapted to receive a tongue 28 formed on the lower edge of the panel above it in the assembled element 20. A rubber gasket is placed between the two panels at this connection. A corrugation 29 on the front sheet 21 is located on the same level as a corrugation 31 on the rear sheet 22. The corrugation 29 is of trapezoidal cross-sectional shape and the panel has a half corrugation 32 along its upper edge and a half corrugation 33 along its lower edge. The corrugation formed by the junction of the half corrugation on the lower edge of an upper panel with the half corrugation on the upper edge of a low panel is of the same size and shape as the intermediate corrugation 29. Each corrugation 29 consists of a flat portion 34 lying in spaced parallel relationship to the main body of the sheet and the grating 25 and of two inclined portions 35 and 36 extending from the main body to the upper and lower edges, respectively, of the flat portion. It should be noted that perforations 37 are provided only on the main body and on the inclined portions 35 and 36. No perforations are provided on the flat portions 34 or on any part of the rear sheet 22 and its corrugation 31.

Figure 4:
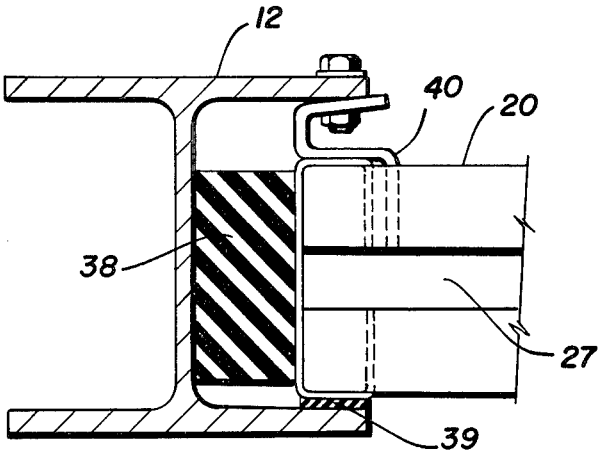
FIG. 4 is a sectional view of the element taken on the line IV—IV of FIG. 1.

FIG. 4 shows the manner in which the vertical edge of the panel 20 is held in the groove in the I-beam 12 by use of resilient elements. In the preferred embodiment, a block 38 of rubber engages the edge, a thin block 39 of rubber lies along the front side, and a sheet metal spring clamp 40 lies along the rear side.

When the system is used on damp premises or in the open, it is advisable to use corrosion-proof material, both for the panels and for the wire grating, or else to provide any profiled sheets or wire gratings which may in themselves be subject to corrosion with a means of protecting the surface. Both the sheets and the wire grating may be galvanized or provided with coatings of lacquer or plastic.

In order to prevent water from accumulating in the noise-prevention element when condensation forms or when the system is used in the open, the lower frame bar is provided with holes enabling the water to drain off.

Alternative versions of the invention are possible. For example, the noise-prevention element shown in FIGS. 2 and 3 may be provided, in addition, with frame bars extending over its sheets and in each case belts may be provided, preferably situated in the edge zones. These bolts or the edge zones, particularly holes passing through the branches of the frame bars, can facilitate the task of affixing the noise prevention element. It is also possible for attachment or prolongations of the frame bars, extending beyond the noise-prevention elements, to be used for securing the system, or for the said frame bars to be additionally provided with straps, angle irons, etc.

The sound-absorbing and noise-prevention elements shown can be used universally. For example, the noise-prevention elements can be installed in factories, schools, churches and other buildings, in the form of wall and/or ceiling elements, to reduce the echo or lower the noise level. In this case they can stand free in the interior, in order to distribute their base surface, or they can take the form of a wall or ceiling covering or else actually constitute the ceiling or outer wall surfaces.

The sound-absorbing element covered by the invention may also be used for the lining of compressor shafts, particularly engine rooms or the like, and for the provision of compressor pipes it may be made in tubular form: the two panel surfaces are then replaced by an internal tube and an outer tube surrounding it at a certain distance, the intermediate space being filled with shredded or granulated rubber. The theories on which the invention is based can also be applied to the provision of door surfaces, folding door surface or window shutters: as a general principle the sound-absorbing elements already described can likewise be used as the leaves of doors or the shutters of windows. Particularly when they are used as the leaves of doors, however, it is advisable to take special measures which increase both their stability and their resistance to heat, while at the same time ensuring that the method by which they are manufactured is the most suitable for their purpose.

The sound-absorbing element can be constructed to practically any dimensions. Its size, its sound absorption and its resistance to weather conditions make it an ideal means of screening off special sources of noise, such as industrial areas, building sites and airports, but it is also suitable for sports grounds, shooting booths and swimming baths in the vicinity of residential areas or housing settlements. Even if, particularly in the latter case, it is advisable for the sound-absorbing element to be constructed in the form of a comparatively large sheet, it is nevertheless possible, for the construction of the walls of buildings, or for any desired system of the venetian blind type, to adopt other dimensions. To obtain particularly high absorption values it is also possible for the sound-absorbing element not only to be provided with a series of cavities and a filling layer of shredded or granulated scrap rubber but also to be subdivided still further, with the provision of intermediate gratings or intermediate panels, in order to provide room for a further layer of sound-absorbing filling material. Similarly, layers of sound-proofing or sound-absorbing material applied to the panels from the inside or from the outside can be provided in addition, and layers serving to increase the resistance to corrosion can be made sound-proof in their structure and composition. In all these cases a sound-absorbing or noise-prevention element of high absorptive capacity is provided, which can be produced and erected at moderate cost.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A sound-absorbing element, comprising:
(a) a pair of posts adapted to be mounted in the ground in spaced, parallel relationship, the posts having facing grooves, and
(b) a plurality of panels carried in the grooves and mounted one above the other, each panel consisting of a corrugated, perforated front sheet forming the front outer wall of the panel, a corrugated rear sheet forming the rear outer wall of the panel and held in spaced non-contacting relationship to the front sheet, a perforated wall lying against the front sheet, and a body of loose particles of an elastomer material lying between the rear sheet and the perforated wall.

2. A sound-absorbing element, as recited in claim 1, wherein the perforations in the front sheet occupy at least 25 percent of the surface of the sheet.

3. A sound-absorbing element as recited in claim 1, wherein the adjacent panels are joined by a tongue-and-groove construction.

4. A sound-absorbing element as recited in claim 1, wherein each corrugation of the front sheet is located on the same level as a corrugation on the rear sheet, wherein each corrugation is of trapezoidal cross-sectional shape, and wherein each panel has a half corrugation at its upper and its lower edge.

5. A sound-absorbing element as recited in claim 4, wherein the corrugation formed by the junction of the half corrugation on an upper panel with the half corrugation of the next adjacent lower panel is the same size and shape as an intermediate corrugation.

6. A sound-absorbing element as recited in claim 1, wherein the particles consist of comminuted shreds of scrap rubber held together to form a cohesive mat.

7. A sound-absorbing element as recited in claim 1, wherein the posts are I-beams and the end edges of the panels are held in the groove between the beam flanges by resilient members.

8. A sound-absorbing element as recited in claim 1, wherein each corrugation consists of a flat portion lying in spaced, parallel relationship to the main body of the sheet and two inclined portions extending from the main body to the edges of the flat portion, perforations being provided on the inclined portions only.

* * * * *